US009822747B2

(12) United States Patent
Prodi et al.

(10) Patent No.: US 9,822,747 B2
(45) Date of Patent: Nov. 21, 2017

(54) METHOD TO CONTROL AN ELECTROMAGNETIC ACTUATOR OF AN INTERNAL COMBUSTION ENGINE

(71) Applicant: Magneti Marelli S.p.A., Corbetta (IT)

(72) Inventors: Giovanni Prodi, Bologna (IT); Fabio Sensi, Casalecchio di Reno (IT); Luca Mancini, Budrio (IT)

(73) Assignee: Magneti Marelli S.p.A., Corbetta (IT)

( * ) Notice: Subject to any disclaimer, the term of this patent is extended or adjusted under 35 U.S.C. 154(b) by 379 days.

(21) Appl. No.: 14/600,257

(22) Filed: Jan. 20, 2015

(65) Prior Publication Data

US 2015/0204286 A1 Jul. 23, 2015

(30) Foreign Application Priority Data

Jan. 21, 2014 (IT) ..... BO2014A0023

(51) Int. Cl.

| | |
|---|---|
| ***F02D 41/30*** | (2006.01) |
| ***F02M 59/36*** | (2006.01) |
| ***F02D 41/20*** | (2006.01) |
| ***F02D 41/38*** | (2006.01) |

(52) U.S. Cl.

CPC ..... *F02M 59/368* (2013.01); *F02D 41/20* (2013.01); *F02D 41/30* (2013.01); *F02D 41/3845* (2013.01); *F02D 2041/202* (2013.01); *F02D 2041/2017* (2013.01)

(58) Field of Classification Search

CPC ..... F02M 51/04; F02M 59/44; F02M 59/368; F02D 41/20; F02D 41/3845; F02D 41/30

See application file for complete search history.

(56) References Cited

U.S. PATENT DOCUMENTS

| | | | | |
|---|---|---|---|---|
| 5,803,049 | A * | 9/1998 | Harcombe | F02D 41/20 123/299 |
| 2010/0145597 | A1 | 6/2010 | Keegan et al. | |
| 2012/0080536 | A1 * | 4/2012 | Parrish | F02D 41/20 239/5 |

FOREIGN PATENT DOCUMENTS

| | | | | |
|---|---|---|---|---|
| EP | 1995440 | A2 | 11/2008 | |
| EP | 2236809 | A2 | 10/2010 | |
| EP | 2453122 | A1 | 5/2012 | |
| EP | 2554825 | A2 | 2/2013 | |
| JP | EP 2453122 | A1 * | 5/2012 | F02D 41/20 |
| WO | 03081007 | A1 | 10/2003 | |

OTHER PUBLICATIONS

Oct. 21, 2014 Italian Search Report for Italian Patent Application No. IT BO20140023.

* cited by examiner

*Primary Examiner* — Jacob Amick
(74) *Attorney, Agent, or Firm* — Howard & Howard Attorneys PLLC

(57) ABSTRACT

Method to control an electromagnetic actuator of an internal combustion engine, in particular for a fuel pump of a direct-injection system; wherein the electromagnetic actuator is controlled by an electric current pulse of the Peak&Hold type, i.e. subdivided into a peak phase and a hold phase; the method includes acquiring the initial duration of the peak phase, during which a peak control current is to be supplied to the electromagnetic actuator to control the movement of a component of the electromagnetic actuator moving towards a position defined by a limit stop; and determining the duration of the peak phase by progressively decreasing the initial duration of the peak phase by a first change.

20 Claims, 4 Drawing Sheets

METHOD TO CONTROL AN ELECTROMAGNETIC ACTUATOR OF AN INTERNAL COMBUSTION ENGINE

CROSS-REFERENCE TO RELATED APPLICATION

This application is based upon and claims priority to Italy Patent Application No. BO2014A000023, filed on Jan. 21, 2014.

BACKGROUND OF THE INVENTION

1. Field of the Invention

The present invention relates, generally, to electromagnetic actuators and, more specifically, to a method of controlling an electromagnetic actuator of an internal combustion engine.

2. Description of the Related Art

A direct-injection system includes a plurality of injectors, a common rail, which feeds pressurized fuel to the injectors, a high-pressure pump, which feeds fuel to the common rail through a high-pressure feed line and is provided with a flow-rate adjusting device, and a control unit, which controls the flow-rate adjusting device so as to cause the fuel pressure on the inside of the common rail to be equal to a desired value, which normally varies in time as a function of the engine operating conditions.

A high pressure fuel pump, as described in patent application EP2236809A1, includes a pumping chamber, in which a piston slides back and forth, an intake pipe regulated by an intake valve to feed low-pressure fuel to the pumping chamber, and a delivery pipe regulated by a delivery valve to feed high-pressure fuel from the pumping chamber along the feed line to the common rail.

The intake valve is normally pressure-controlled and, in the absence of external intervention, is closed when the fuel pressure in the pumping chamber is higher than the fuel pressure in intake channel, and is open when the fuel pressure in the pumping chamber is lower than the fuel pressure in intake channel. The flow-rate adjusting device is mechanically coupled to the intake valve so that, when necessary, the intake valve can be kept open during the piston pumping phase, thus allowing the fuel to flow out of the pumping chamber through the intake channel. In particular, the flow-rate adjusting device includes a control rod, which is coupled to the intake valve and is movable between a passive position, in which it allows the intake valve to close, and an active position, in which it prevents the intake valve from closing. The flow-rate adjusting device includes, furthermore, an electromagnetic actuator, which is coupled to the control rod so as to move it between the active position and the passive position. The electromagnetic actuator includes a spring, which holds the control rod in the active position, and an electromagnet, which is designed to move the control rod to the passive position by magnetically attracting a ferromagnetic anchor, which is integral to the control rod, against a fixed magnetic armature.

In use, the high-pressure pump described in patent application EP2236809A1 produces a sound similar to a ticking noise, which can clearly be perceived when the engine runs slow (namely, when the overall noise produced by the engine is moderate). The noise generated by the high-pressure fuel pump can be perceived in a clear manner also because the high-pressure fuel pump, having to receive the motion from the drive shaft, is directly mounted on the head of the engine, the head of the engine transmitting and diffusing the vibration generated by the high-pressure pump.

The noise produced by the high-pressure pump in use is basically due to the cyclical hits of the mobile equipment of the flow-rate adjusting device (namely, of the control rod and of the anchor) against the intake valve (strike corresponding to the active position) and against the magnetic armature of the electromagnet (strike corresponding to the passive position).

In order to reduce this noise, one could act, via software, upon the intensity and the waveform of the control current of the electromagnet, so as to minimize of kinetic energy of the mobile equipment when it hits the intake valve and the magnetic armature. Experiments have shown that, by acting via software upon the control current of the electromagnet, one can significantly reduce the kinetic energy of the mobile equipment when it hits the magnetic armature. On the other hand, experiments have shown that, by acting via software upon the control current of the electromagnet, it is much more complicated and expensive to significantly reduce the kinetic energy of the mobile equipment when it hits the intake valve.

In order to significantly reduce the kinetic energy of the mobile equipment at the moment of the impact, the control system should excite the electromagnet with a control current that is as close as possible to the "limit" control current (which gives to the mobile equipment the "minimum" kinetic energy at the moment of the impact), but, especially, the control system should excite the electromagnet with a control current that is never below the "limit" control current, otherwise the actuation is lost (namely, the mobile equipment never reaches the desired position due to an insufficient kinetic energy). The value of the "limit" control current is extremely variable from case to case due to constructive losses and to creeps caused by times, temperature, battery voltage, engine speed and, usually, different operating point.

In order to reduce the noise produced at the moment of the impact of the mobile equipment against the intake valve, since there is no way to check whether the limit position has been reached (namely, whether the actuation has been completed), one can advantageously use an electromagnetic actuator provided with a one-way hydraulic brake, which is integral to the control rod and slows down the movement of the rod; in particular, the hydraulic brake moves the control rod between a passive position, in which the control rod allows the intake valve to close, and an active position, in which the control rod does not allow the intake valve to close; and the hydraulic brake is suited to generate a high braking force, when the control rod move towards the active position, and to generate a negligible breaking force, when the control rod moves towards the passive position.

When the mobile equipment hits the magnetic armature, the control system is able to check whether the limit position has been reached (namely, whether the actuation has been completed) by observing the fuel pressure in the common rail (when the control rod hits the magnetic armature, the intake valve closes and, therefore, the high-pressure fuel pump starts to pump pressurized fuel, which increases the fuel pressure in the common rail). Then the control system can progressively reduce the control current, until the reaching of the limit position (namely, the completion of the actuation) disappears; now it can slightly increase the control current so as to carry out the actuation with the "minimum" kinetic energy at the moment of the impact.

Over the course of time, though, the control system proves to be inefficient in the limitation of the kinetic energy of the impact and, therefore, in the limitation of the noise produced, due to behaviour losses of the magnetic actuator.

SUMMARY OF THE INVENTION

The present invention overcomes the disadvantages in the related art in controlling an electromagnetic actuator of an internal combustion engine. An object of the present invention is to provide a method to control an electromagnetic actuator of an internal combustion engine, the method being free from the drawbacks described above and, at the same time, easy and cheap to be implemented.

A further object of the present invention is to provide an electronic unit to control an electromagnetic actuator of an internal combustion engine, said electronic control unit being free from the drawbacks of the prior art and, at the same time, easy and cheap to be manufactured.

The present invention provides a method to control an electromagnetic actuator of an internal combustion engine and an electronic control unit according to the appended claims.

BRIEF DESCRIPTION OF THE DRAWINGS

Other objects, features, and advantages of the present invention will be readily appreciated as the same becomes better understood after reading the subsequent description taken in connection with the accompanying drawings wherein.

DETAILED DESCRIPTION OF THE INVENTION

Figure 1:
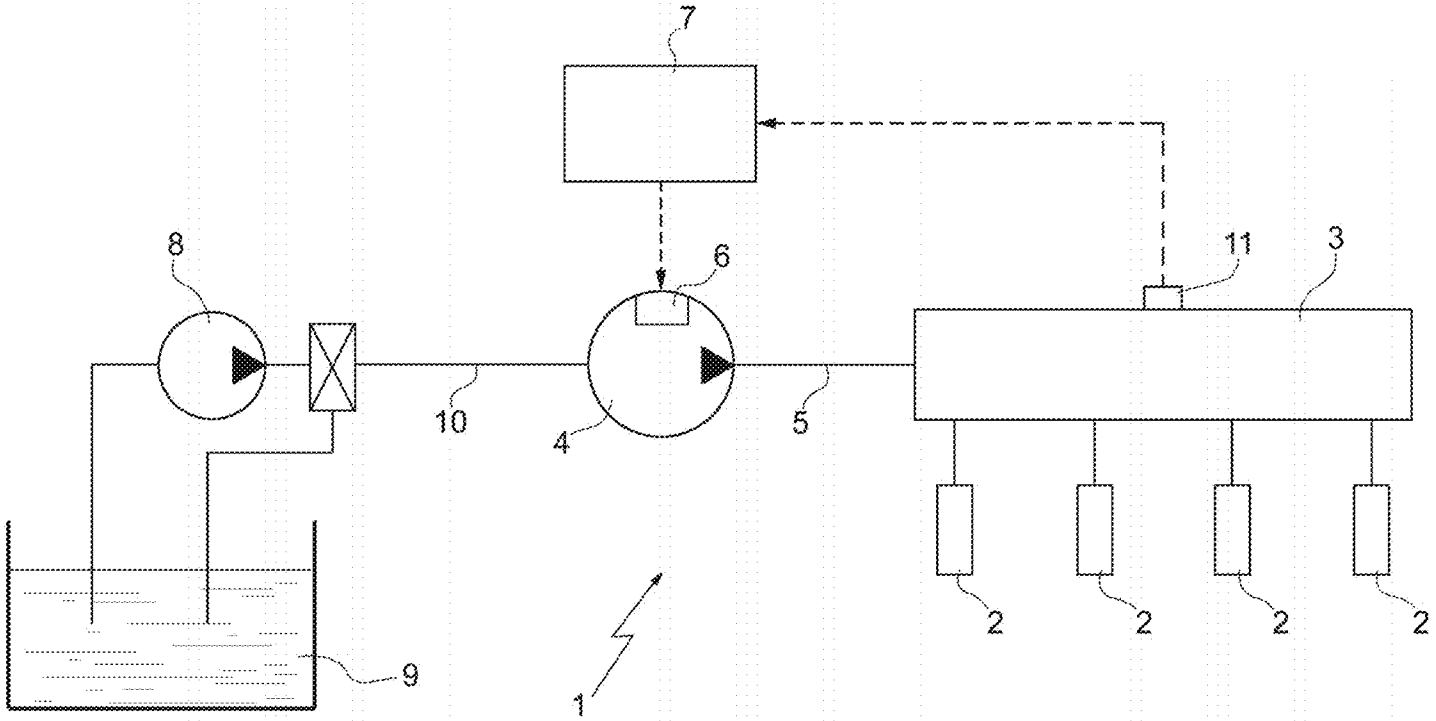
FIG. 1 shows a schematic view, with some details removed for greater clarity, of a fuel direct-injection system of the common rail type.

With reference now to the drawings, FIG. 1 shows, as a whole, a common-rail, fuel direct-injection system 1, in particular using gasoline as a fuel, for an internal combustion engine ICE.

The direct-injection system 1 includes a plurality of injectors 2, a common rail 3, which feeds pressurized fuel to the injectors 2, a high-pressure pump 4, which feeds fuel to the common rail 3 through a feed line 5 and is provided with a flow-rate adjusting device 6, a control unit 7, which causes the fuel pressure on the inside of the common rail 3 to be equal to a desired value, which generally varies in time as a function of the engine operating conditions, and a low-pressure pump 8, which feeds fuel from a tank 9 to the high-pressure pump 4 through a feed line 10.

The control unit 7 is coupled to the flow-rate adjusting device 6 so as to control the flow-rate of the high-pressure pump 4, so that the common rail 3 is supplied, instant by instant, with the amount of fuel necessary to have the desired pressure value in the common rail 3; in particular, the control unit 7 regulates the flow-rate of the high-pressure pump 4 by feedback control, which uses, as a feedback variable, the value of the fuel pressure on the inside of the common rail 3, the value of the pressure being detected, in real time, by a pressure sensor 11.

Figure 2:
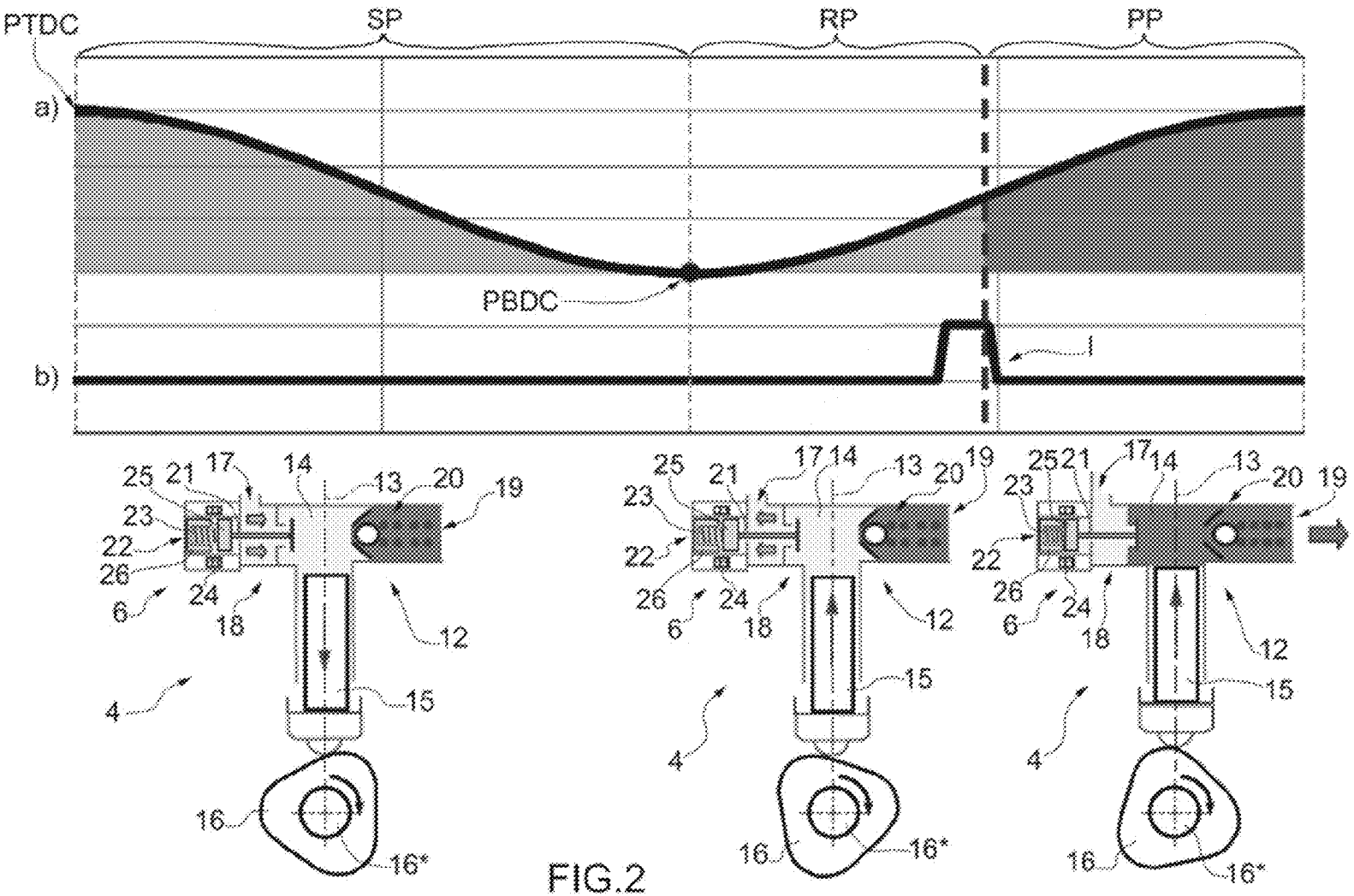
FIG. 2 shows the operating cycle of a high-pressure pump of the direct-injection system of FIG. 1.

As schematically shown in FIG. 2, the high-pressure pump 4 includes a main body 12, which has a longitudinal axis 13 and defines, on the inside, a cylindrical pumping chamber 14. A piston 15 is mounted and slides on the inside of the pumping chamber 14, and, as it slides back and forth along the longitudinal axis 13 due to the action of the lobes 16 of a camshaft 16*, it determines a cyclical change in the volume of the pumping chamber 14. A lower portion of the piston 15 is coupled to a spring, which, on one side, pushes the piston 15 towards a position producing a maximum volume of the pumping chamber 14, and, on the other side, is coupled to the camshaft 16*, which is caused to rotate by a drive shaft of the engine so as to cyclically to move piston 15 upwards compressing the spring 16.

An intake channel 17 originates from a lateral wall of the pumping chamber 14, the intake channel 17 being connected to the low-pressure pump 8 by the feed line 10 and being regulated by an intake valve 18, which is arranged in correspondence to the pumping chamber 14. The intake valve 18 is normally pressure-controlled and, in the absence of external intervention, is closed when the fuel pressure in the pumping chamber 14 is higher than the fuel pressure in intake channel 17, and is open when the fuel pressure in the pumping chamber 14 is lower than the fuel pressure in intake channel 17.

A delivery channel 19 originates from a lateral wall of the pumping chamber 14 on the opposite side relative to the intake channel 17, the delivery channel 19 being connected to the common rail 3 by the feed line 5 and being regulated by a one-way delivery valve 20, which is arranged in correspondence to the pumping chamber 14 and only allows fuel to flow out of the pumping chamber 14. The delivery valve 20 is normally pressure-controlled and is open when the fuel pressure in the pumping chamber 14 is higher than the fuel pressure in delivery channel 19, and is closed when the fuel pressure in the pumping chamber 14 is lower than the fuel pressure in delivery channel 19.

The flow-rate adjusting device 6 is mechanically coupled to the intake valve 18 so as to allow the control unit 7, when necessary, to keep the intake valve 18 open during a reflux phase RP of the piston 15, thus allowing the fuel to flow out of the pumping chamber 14 through the intake channel 17 (as we will better explain below). The flow-rate adjusting device 6 includes a control rod 21, which is coupled to the intake valve 18 and is movable between a passive position, in which it allows the intake valve 18 to close and the hydraulic communication between the pumping chamber 14 and the intake channel 17 is cut off, and an active position, in which it does not allow the intake valve to close and the hydraulic communication between the pumping chamber 14 and the intake channel 17 is enabled. The flow-rate adjusting device 6 includes, furthermore, an electromagnetic actuator 22, which is coupled to the control rod 21 so as to move it between the active position and the passive position.

The electromagnetic actuator 22 includes a spring 23, which holds the control rod 21 in the active position, and an electromagnet 24, which is controlled by the control unit 7 and is designed to move the control rod 21 to the passive position by magnetically attracting a ferromagnetic anchor 25, which is integral to the control rod 21. When the electromagnet 24 is energized, the control rod 21 is moved back to the passive position and the communication between the intake channel 17 and the pumping chamber 14 can be cut off by closing the intake valve 18. The electromagnet 24 includes a fixed magnetic armature 26 (or magnetic bottom), which is surrounded by a coil; when an electric current flows through it, the coil generates a magnetic field that magnetically attracts the anchor 25 towards the magnetic armature 26. The control rod 21 and the anchor 25 form, together, a mobile equipment of the flow-rate adjusting device 6, which axially moves between the active position and the passive position, controlled by the electromagnetic actuator 22. The magnetic armature 26 advantageously has an annular shape with a central hole, so as to have a central empty space that can house the spring 23.

In one embodiment, the electromagnetic actuator 22 includes a one-way hydraulic brake, which is integral to the control rod 21 and is designed to slow down the movement of the mobile equipment (i.e. of the control rod 21 and of the anchor 25) only when the mobile equipment moves towards the active position (namely, the hydraulic brake does not slow down the movement of the mobile equipment when the mobile equipment moves towards the passive position).

The electromagnetic actuator 22 is controlled by the control unit 7 and is supplied with an electric current curve that, in FIG. 2, is indicated with b) and is substantially synchronous with the top dead centre PTDC of the high-pressure pump 4. In particular, the control unit 7 transmits electric current pulses I, whose duration can vary as a function of the operating point of the internal combustion engine, namely of its speed, whereas the timing of the electric current pulses I can vary as a function of the fuel flow-rate flowing out of the pumping chamber 14.

The operating cycle of the high-pressure pump 4, which is indicated with a) in FIG. 2, substantially includes three phases. The operating cycle of the high-pressure pump 4 is identified by each of the lobes 16 of the camshaft 16*, which determines a cyclical change in the volume of the pumping chamber 14.

An intake phase SP, which beings in correspondence to the top dead centre PTDC of the high-pressure pump 4. During the intake phase SP, the piston 15 moves downwards along the longitudinal axis 13, the intake valve 18 is open and the control rod 21 is in the active position, so as to allow fuel to flow into the pumping chamber 14 through the intake channel 17.

A reflux phase RP follows the intake phase SP of the high-pressure pump 4 and starts in correspondence to the bottom dead centre PTDC of the high-pressure pump 4. During the reflux phase RP, the piston 15 moves upwards along the longitudinal axis 13, the intake valve 18 is kept open and the control rod 21 is in the active position. In this way, the fuel flowing out of the pumping chamber 14 flows through the intake channel 17 and towards the low-pressure circuit.

Finally, a pumping phase PP follows the reflux phase RP of the high-pressure pump 4. The pumping phase PP of the high-pressure pump 4 begins in correspondence to the command of the control unit 7 that supplies the electromagnetic actuator 22 with an electric current pulse I. The intake valve 18 is closed due to the reflux of the fuel that flows out of the pumping chamber 14 through the intake channel 17 and towards the low-pressure circuit. After the intake valve 18 has been closed, the fuel pressure on the inside of the pumping chamber 14 reaches a value that is such as to cause the opening of the one-way delivery valve 20, which is arranged in correspondence to the pumping chamber 14 and allows fuel to flow out of the pumping chamber 14. In other words, the opening of the one-way delivery valve 20 takes place when the fuel pressure on the inside of the pumping chamber 14 is higher than the fuel pressure in the delivery channel 19.

When, in use, the mobile equipment (namely, the control rod 21 and the anchor 25) of the flow-rate adjusting device 6 moves towards the passive position, thus moving away from the active position and allowing the intake valve 18 to close so as to start feeding pressurized fuel to the common rail 3, the movement towards the passive position has a substantial effect on the operation of the high-pressure pump 4 and, therefore, should be as quick as possible, so as to facilitate and improve control. Since the kinetic energy of the mobile equipment at the moment of the impact against the magnetic armature 26 is a function of the square of the speed, this kinetic energy is substantially great.

The repetition, for each electric current pulse I supplied to the electromagnetic actuator 22, of the impact of the mobile equipment (namely, of the control rod 21 and the anchor 25) against the magnetic armature 26 produces a periodical noise that can be perceived as being very annoying for human ears.

The method described below is implemented by the control unit 7 to reduce the noise produced by the high-pressure pump 4 and, in particular, to reduce the noise caused by the movement of the mobile equipment (namely, of the control rod 21 and the anchor 25) that hits the magnetic armature 26.

First of all, it should be pointed out that the control unit 7 is designed to control each electric current pulse I supplied to the electromagnetic actuator 22 with a Peak&Hold command, namely a command that is divided into a peak phase (which is needed to move the control rod 21 from the active position to the passive position) and a hold phase (which is needed to hold the control rod 21 in the passive position, until the pressure in the pumping chamber 14 reaches a sufficient value).

In order to enable the strategy for the reduction of the noise caused by the movement of the mobile equipment (namely, of the control rod 21 and the anchor 25) that hits the magnetic armature 26, the internal combustion engine ICE should be in specific conditions in terms of loads and number of revolutions. Therefore, the control unit 7 is designed to enable the noise reduction strategy only in given load and rpm conditions. In particular, in a preliminary adjustment and set up phase to be performed on the control unit 7, one should determine load and rpm threshold values, below which the control unit 7 pursues the strategy for the reduction of the noise caused by the movement of the mobile equipment (namely, of the control rod 21 and the anchor 25) that hits the magnetic armature 26. The strategy for the reduction of the noise caused by the movement of the mobile equipment (namely, of the control rod 21 and the anchor 25) that hits the magnetic armature 26 is pursued only in a low-load and slow-running condition, namely with a low number of revolutions per minute.

Hence, the strategy for the reduction of the noise caused by the movement of the mobile equipment (namely, of the control rod 21 and the anchor 25) that hits the magnetic armature 26 is not pursued in high- or medium-load and high-rpm conditions (in other words, when the load and rpm threshold values established in a preliminary phase and stored in the control unit 7 are exceeded).

It should be pointed out that, in high- or medium-load and high-rpm conditions, the noise produced by the movement of the mobile equipment (namely, of the control rod 21 and the anchor 25) that hits the magnetic armature 26 is negligible compared to the noise produced by the speed of the internal combustion engine ICE and by the combustion taking place therein. Furthermore, as we will explain better below, pursuing the strategy for the reduction of the noise caused by the movement of the mobile equipment (namely, of the control rod 21 and the anchor 25) that hits the magnetic armature 26 could be dangerous in high- or medium-load and high-rpm conditions (because the lack of actuation, in the high-pressure pump 4, would lead to non-negligible pressure drops, as they are proportional to the quantity of fuel injected), whereas pursuing the strategy for the reduction of the noise caused by the movement of the mobile equipment (namely, of the control rod 21 and the anchor 25) that hits the magnetic armature 26 is totally safe in low-load and slow-running conditions, namely with a low number of revolutions per minute.

Furthermore, it should be pointed out that, for the entire amount of time during which the strategy for the reduction of the noise caused by the movement of the mobile equipment (namely, of the control rod 21 and the anchor 25) that hits the magnetic armature 26 is pursued, the fuel pressure value on the inside of the common rail 3, which feeds pressurized fuel to the injectors 2, is continuously monitored. The fuel pressure value on the inside of the common rail 3 is detected in real time by the pressure sensor 11.

Therefore, the control unit 7 is designed to progressively decrease the duration of the peak phase, namely to excite the electromagnet 24 with the peak control current I (hereinafter simply referred to as control current I), which is supplied during the peak phase ΔT, whose duration is such as to give to the mobile equipment (namely, to the control rod 21 and the anchor 25) the kinetic energy that is necessary and sufficient to move the rod 21 from the active position to the passive position. In one embodiment, in the control unit 7 there are stored a series of maps that provide the duration of an initial peak phase $\Delta T_{START}$, during which the electromagnet 24 is to be supplied with the control current I, as a function of a plurality of parameters, such as, for example: battery voltage V, temperature of the winding of the electromagnetic actuator 22, temperature of the fuel used, speed of the internal combustion engine ICE, or other parameter.

Therefore, the duration of the peak phase ΔT, during which the electromagnet 24 is to be supplied with the control current I so as to give to the mobile equipment (namely, to the control rod 21 and the anchor 25) the kinetic energy needed to move the rod 21 from the active position to the passive position is initialized to a value that is equal to the duration of the initial peak phase $\Delta T_{START}$ stored in the control unit 7.

Hence, the duration of the peak phase ΔT, during which the electromagnet 24 is to be supplied with the control current I, is progressively decreased until a value is reached, which is as close as possible to the "limit" duration that gives to the mobile equipment the minimum kinetic energy at the moment of the impact. In particular, the duration of the peak phase ΔT, during which the electromagnet 24 is to be excited with the control current I, is greater than o equal to the "limit" duration, which would cause the loss of the actuation (condition in which the mobile equipment made up of the control rod 21 and the anchor 25 never reaches the desired position due to an insufficient kinetic energy).

The duration of the peak phase ΔT, during which the electromagnet 24 is to be excited with the control current I, is progressively decreased by a quantity $\Delta T_{P1}$.

In one embodiment, in the control unit 7 there are stored a series of maps that provide the quantity $\Delta T_{P1}$ to be subtracted from the peak phase ΔT, during which the electromagnet 24 is to be excited with the control current I so as to give to the mobile equipment the energy needed, as a function of a plurality of parameters, such as, for example: battery voltage V, temperature of the winding of the electromagnetic actuator 22, temperature of the fuel used, speed of the internal combustion engine ICE, etc.

In one embodiment, the duration of the peak phase ΔT, during which the electromagnet 24 is to be excited with the control current I, is decreased by a quantity $\Delta T_{P1}$ with every actuation of the electromagnetic actuator 22, as shown in the figures from 4-I to 4-IX (each of them showing an actuation of the electromagnetic actuator 22, wherein the development of the current is indicated with I and the development of the voltage is indicated with V).

Therefore, the following equation [1] proves correct:

$$\Delta T_i = \Delta T_{i-1} - \Delta T_{P1} \quad [1]$$

where $\Delta T_{i\ is}$ the duration of the peak phase, during which the electromagnet 24 is to be excited with the control current I for the i-th actuation of the electromagnetic actuator 22; $\Delta T_{i-1}$ is the duration of the peak phase, during which the electromagnet 24 is to be excited with the control current I for the (i−1)-th actuation of the electromagnetic actuator 22; $\Delta T_{P1}$ is the change of duration; and i is the actuations of the electromagnetic actuator (22).

In an alternative embodiment, the duration of the peak phase ΔT, during which the electromagnet 24 is to be excited with the control current I, is kept constant over a given number $N_{A1}$ of actuations of the electromagnetic actuator 22 before decreasing it again by the quantity $\Delta T_{P1}$ In other words, the duration of the peak phase ΔT, during which the electromagnet 24 is to be excited with the control current I, is decreased by a quantity $\Delta T_{P1}$ with every given number $N_{A1}$ of actuations of the electromagnetic actuator 22.

In one embodiment, in the control unit 7 there are stored a series of maps that provide the number of $N_{A1}$ of actuations of the electromagnetic actuator 22 as a function of a plurality of parameters, such as, for example: battery voltage V, temperature of the winding of the electromagnetic actuator 22, temperature of the fuel used, speed of the internal combustion engine ICE, etc.

Therefore, the following equation [2] proves correct:

$$\Delta T_i = \Delta T_{(i-N_{A1})} - \Delta T_{P1} \quad [2]$$

where $\Delta T_i$ is the duration of the peak phase, during which the electromagnet 24 is to be supplied with the control current I for the i-th actuation of the electromagnetic actuator 22; $\Delta T_{(i-N_{A1})}$ is the duration of the peak phase, during which the electromagnet 24 is to be excited with the control current I for the (i−$N_{A1}$)-th actuation of the electromagnetic actuator (22); $\Delta T_{P1}$ is the change of duration; $N_{A1}$ is the predetermined number of actuations of the electromagnetic actuator 22; and i is the actuations of the electromagnetic actuator (22).

During the entire learning step, aimed at learning the duration of the peak phase ΔT, during which the electromagnet 24 is to be excited with the control current I, the fuel pressure value on the inside of the common rail 3 is constantly monitored by the pressure sensor 11.

As soon as the control unit 7, through the pressure sensor 11, detects a decrease in the fuel pressure value on the inside of the common rail 3, it cuts off the step aimed at progressively decreasing the quantity $\Delta T_{P1}$ of the duration of the peak phase ΔT, during which the electromagnet 24 is to be excited with the control current I. As a matter of fact, a decrease in the fuel pressure value on the inside of the common rail 3 means that there has been a decrease in the flow-rate of the fuel flowing out of the high-pressure pump 4 caused by the loss of the actuation of the electromagnetic actuator 22 (in this case, the mobile equipment including the control rod 21 and the anchor 25 does not reach the desired position due to an insufficient kinetic energy).

In particular, the step aimed at progressively decreasing the duration of the peak phase ΔT, during which the electromagnet 24 is to be excited with the control current I, by the quantity $\Delta T_{P1}$ is cut off as soon as the control unit 7 detects a decrease in the fuel pressure value on the inside of the common rail 3, which is higher than a tolerance value, which is usually determined in a preliminary set up phase aimed at setting up the control unit 7. In other words, the step aimed at progressively decreasing the duration of the peak phase ΔT is cut off as soon as the control unit 7 detects a fuel pressure value on the inside of the common rail 3 that is not part of an interval of acceptable values for the fuel pressure on the inside of the common rail 3, whose width is usually determined in a preliminary set up phase aimed at setting up the control unit 7.

As an alternative to or in combination with what described above, the step aimed at progressively decreasing the duration of the peak phase ΔT, during which the electromagnet 24 is to be excited with the control current I, by the quantity $\Delta T_{P1}$ is cut off as soon as the control unit 7 detects a drop in the fuel pressure value on the inside of the common rail 3 during the last n cycles, which is higher than a threshold value, the threshold value and the number n of cycles being usually determined in a preliminary set up phase aimed at setting up the control unit 7. In other words, the step aimed at progressively decreasing the duration of the peak phase ΔT is cut off as soon as the control unit 7 detects that, over a number n of successive cycles, there has been a drop in the fuel pressure value on the inside of the common rail 3, which is higher than a threshold value.

As an alternative to or in combination with what described above, it is possible to determine a tolerance value; to detect the fuel pressure value on the inside of the common rail 3; and to allow the duration of the peak phase ΔT, during which the electromagnet 24 is to be excited with the control current I, to be progressively decreased by the quantity $\Delta T_{P1}$ only in case the total reduction of fuel pressure value on the inside of the common rail 3 over a number n of successive working cycles is higher than the tolerance value.

Figure 4:
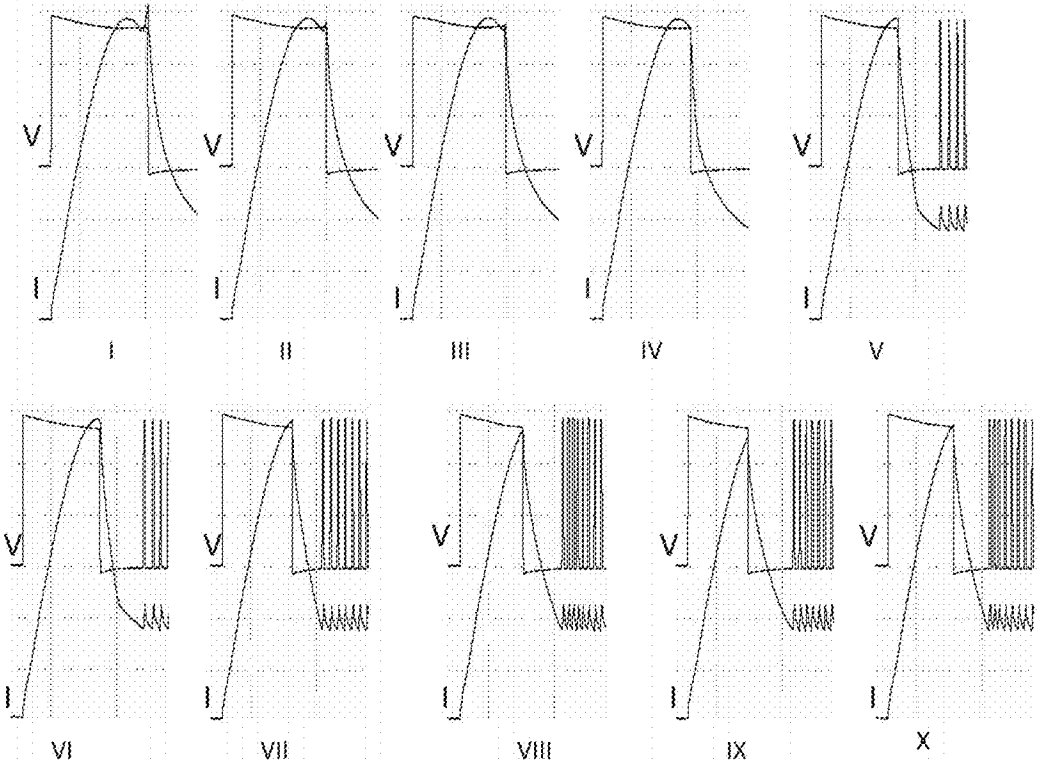
FIG. 4 shows a schematic of the actuation strategy of an electromagnetic actuator of the high-pressure fuel pump of FIG. 2 in low-load and low-rpm conditions.

As soon as the control unit 7 detects, by the pressure sensor 11, a decrease in the fuel pressure value on the inside of the common rail 3, the duration of the peak phase ΔT, during which the electromagnet is to be excited with the control current I, is increased by a safety value $\Delta T_P$, which is such as to ensure that the fuel pressure value on the inside of the common rail 3 is brought back to a value that is part of the interval of acceptable values, as shown in FIG. 4-X (which shows an actuation of the electromagnetic actuator 22, wherein the development of the current is indicated with I and the development of the voltage is indicated with V).

In one embodiment, in the control unit 7 there are stored a series of maps that provide the safety value $\Delta T_P$ to be added to the duration of the peak phase ΔT, during which the electromagnet 24 is to be excited with the control current I, as a function of a plurality of parameters, such as, for example: battery voltage V, temperature of the winding of the electromagnetic actuator 22, temperature of the fuel used, speed of the internal combustion engine ICE, etc.

The increase by the safety value $\Delta T_P$ is necessary to go back to safety conditions, namely to avoid further losses of actuations of the electromagnetic actuator 22 and to avoid that the mobile equipment made up of the control rod 21 and the anchor 25 does not reach the desired position due to an insufficient kinetic energy. Should the increase by the safety value $\Delta T_P$ not be sufficient to bring the fuel pressure value on the inside of the common rail 3 back to a value that is part of the interval of acceptable values, the control unit 7 is designed to further increase the duration of the peak phase ΔT, during which the electromagnet 24 is to be excited with the control current I, by the safety value $\Delta T_P$ until a fuel pressure value on the inside of the common rail 3 is reached, which is part of the interval of acceptable values.

Therefore, in one embodiment, the control unit 7 is designed to excite the electromagnet 24 with the control current I, which is supplied during the peak phase ΔT and is such as to give to the mobile equipment (namely, to the control rod 21 and the anchor 25) the kinetic energy needed at the moment of the impact against the magnetic armature 26 over a number $N_A$ of actuations of the electromagnetic actuator 22.

In one embodiment, in the control unit 7 there are stored a series of maps that provide the number of $N_A$ of actuations of the electromagnetic actuator 22 as a function of a plurality of parameters, such as, for example: battery voltage V, temperature of the winding of the electromagnetic actuator 22, temperature of the fuel used, speed of the internal combustion engine ICE, etc.

Over the entire amount of time during which the duration of the peak phase ΔT is kept constant (namely, as the number $N_A$ of actuations of the electromagnetic actuator 22 are repeated) the fuel pressure value on the inside of the common rail 3 is constantly monitored by the pressure sensor 11. If, over the entire amount of time during which the duration of the peak phase ΔT is kept constant (namely, as the number $N_A$ of actuations of the electromagnetic actuator 22 are repeated), the control unit 7 detects a decrease in the fuel pressure value on the inside of the common rail 3, the duration of the peak phase ΔT, during which the electromagnet 24 is to be excited with the control current I, is increased by the safety value $\Delta T_P$, so as to ensure that the fuel pressure value on the inside of the common rail 3 is brought back to a value that is part of the interval of acceptable values.

In one embodiment, the control unit 7 is designed to excite the electromagnet 24, during the peak phase ΔT, with the control current I, which is such as to give to the mobile equipment (namely, to the control rod 21 and the anchor 25) the kinetic energy that is necessary and sufficient to move the rod 21 from the active position to the passive position, the duration thereof being progressively decreased by a quantity $\Delta T_{P2}$.

In one embodiment, in the control unit 7 there are stored a series of maps that provide the quantity $\Delta T_{P2}$ to be subtracted from the peak phase ΔT, during which the electromagnet 24 is to be excited with the control current I so as to give to the mobile equipment the energy needed, as a function of a plurality of parameters, such as, for example: battery voltage V, temperature of the winding of the electromagnetic actuator 22, temperature of the fuel used, speed of the internal combustion engine ICE, etc.

In one embodiment, the duration of the peak phase ΔT, during which the electromagnet 24 is to be excited with the control current I, is decreased by a quantity $\Delta T_{P2}$ with every actuation of the electromagnetic actuator 22.

Therefore, the following equation [3] proves correct:

$$\Delta T = \Delta T_{i-1} - \Delta T_{P2} \quad [3]$$

where $\Delta T_i$ is the duration of the peak phase, during which the electromagnet 24 is to be excited with the control current I for the i-th actuation of the electromagnetic actuator 22; $\Delta T_{i-1}$ is the duration of the peak phase, during which the electromagnet 24 is to be excited with the control current I for the (i−1)-th actuation of the electromagnetic actuator 22; $\Delta T_{P2}$ is the change of duration; and i is the actuations of the electromagnetic actuator (22).

In an alternative embodiment, the duration of the peak phase ΔT, during which the electromagnet 24 is to be excited with the control current I, is kept constant over a given number $N_{A2}$ of actuations of the electromagnetic actuator 22 before decreasing it again by the quantity $\Delta T_{P2}$. In other words, the duration of the peak phase ΔT, during which the electromagnet 24 is to be excited with the control current I, is decreased by a quantity $\Delta T_{P2}$ with every given number $N_{A2}$ of actuations of the electromagnetic actuator 22.

In one embodiment, in the control unit 7 there are stored a series of maps that provide the number of $N_{A2}$ of actuations of the electromagnetic actuator 22 as a function of a plurality of parameters, such as, for example: battery voltage V, temperature of the winding of the electromagnetic actuator 22, temperature of the fuel used, speed of the internal combustion engine ICE, etc.

Therefore, the following equation [4] proves correct:

$$\Delta T_i = \Delta T_{(i-N_{A2})} - \Delta T_{P2} \quad [4]$$

where $\Delta T_i$ is the duration of the peak phase, during which the electromagnet 24 is to be excited with the control current I for the i-th actuation of the electromagnetic actuator 22; $\Delta T_{(i-N_{A2})}$ is the duration of the peak phase, during which the electromagnet 24 is to be excited with the control current I for the $(i-N_{A2})$-th actuation of the electromagnetic actuator (22); $\Delta T_{P2}$ is the change of duration; $N_{A2}$ is the predetermined number of actuations of the electromagnetic actuator 22; and i is the actuations of the electromagnetic actuator (22).

During this entire further learning step, aimed at learning the duration of the peak phase ΔT, during which the electromagnet 24 is to be excited with the control current I, the fuel pressure value on the inside of the common rail 3 is constantly monitored by the pressure sensor 11.

As soon as the control unit 7, through the pressure sensor 11, detects a decrease in the fuel pressure value on the inside of the common rail 3, it cuts off the step aimed at progressively decreasing the duration of the peak phase ΔT, during which the electromagnet 24 is to be excited with the control current I, by the quantity $\Delta T_{P2}$.

In particular, the step aimed at progressively decreasing the duration of the peak phase ΔT, during which the electromagnet 24 is to be excited with the control current I, by the quantity $\Delta T_{P2}$ is cut off as soon as the control unit 7 detects a decrease in the fuel pressure value on the inside of the common rail 3, which is higher than a tolerance value, which is usually determined in a preliminary set up phase aimed at setting up the control unit 7. In other words, the step aimed at progressively decreasing the duration of the peak phase ΔT, during which the electromagnet 24 is to be excited with the control current I, by the quantity $\Delta T_{P2}$ is cut off as soon as the control unit 7 detects a fuel pressure value on the inside of the common rail 3 that is not part of an interval of acceptable values for the fuel pressure on the inside of the common rail 3, whose width is usually determined in a preliminary set up phase aimed at setting up the control unit 7.

As an alternative to or in combination with what described above, the step aimed at progressively decreasing the duration of the peak phase ΔT, during which the electromagnet 24 is to be excited with the control current I, by the quantity $\Delta T_{P2}$ is cut off as soon as the control unit 7 detects a drop in the fuel pressure value on the inside of the common rail 3 during the last n cycles, which is higher than a threshold value, the threshold value and the number n of cycles being usually determined in a preliminary set up phase aimed at setting up the control unit 7. In other words, the step aimed at progressively decreasing the duration of the peak phase ΔT is cut off as soon as the control unit 7 detects that, over a number n of successive cycles, there has been a drop in the fuel pressure value on the inside of the common rail 3, which is higher than a threshold value.

As soon as the control unit 7 detects, through the pressure sensor 11, a decrease in the fuel pressure value on the inside of the common rail 3, the duration of the peak phase ΔT, during which the electromagnet is to be excited with the control current I, is increased by the safety value $\Delta T_P$, which is such as to ensure that the fuel pressure value on the inside of the common rail 3 is brought back to a value that is part of the interval of acceptable values.

The increase by the safety value $\Delta T_P$ is necessary to go back to safety conditions, namely to avoid further losses of actuations of the electromagnetic actuator 22, during which the mobile equipment made up of the control rod 21 and the anchor 25 does not reach the desired position due to an insufficient kinetic energy.

It should be pointed out that the quantity $\Delta T_{P2}$ and the number $N_{A2}$ of actuations of the electromagnetic actuator 22 are determined so as to remain as close as possible to the "limit" conditions, namely so as to give to the mobile equipment the minimum kinetic energy at the moment of the impact and so as to avoid values that are below the "limit" duration, which would cause the loss of the actuation of the electromagnetic actuator 22.

In one embodiment, during this step the speed of the reduction of the duration of the peak phase ΔT is fairly slow. In general, the following conditions [5] exist:

$$\Delta T_{P2}/N_{A2} < \Delta T_{P1}/N_{A1} \quad [5]$$

where $\Delta T_{P1}$ is the change of duration, namely time to be subtracted from the duration of the peak phase ΔT; $N_{A1}$ is the number of actuations of the electromagnetic actuator 22; $\Delta T_{P2}$ is the change of duration, namely time to be subtracted from the duration of the peak phase ΔT; and $N_{A2}$ is the number of actuations of the electromagnetic actuator 22.

Finally, the control unit 7 is designed to disable the strategy for the reduction of the noise of the high-pressure pump 4 as soon as the internal combustion engine ICE is in high- or medium-load and high-rpm conditions (in other words, when the load and rpm threshold values established in a preliminary phase and stored in the control unit 7 are exceeded).

Figure 3:
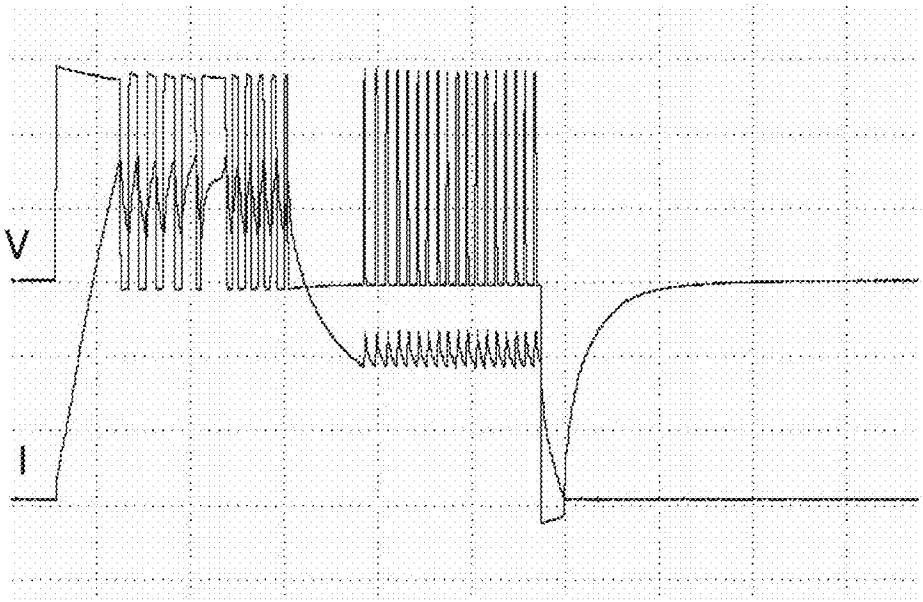
FIG. 3 shows a schematic of the actuation strategy of an electromagnetic actuator of the high-pressure fuel pump of FIG. 2 in high- or medium-load and high-rpm conditions.

The control unit 7 is designed to excite the electromagnet 24 with the control current I, which is supplied during a peak phase ΔT*, whose duration is greater than the duration of the peak phase ΔT, and is such as to give to the mobile equipment (namely, to the control rod 21 and the anchor 25) the kinetic energy that is necessary and sufficient to move the rod 21 from the active position to the passive position as shown in FIG. 3 (wherein the development of the current is indicated with I and the development of the voltage is indicated with V).

It should be pointed out that, in high- or medium-load and high-rpm conditions, the noise produced by the movement of the mobile equipment (namely, of the control rod 21 and the anchor 25) that hits the magnetic armature 26 is negligible compared to the noise produced by the speed of the internal combustion engine ICE and by the combustion taking place therein. Furthermore, in high- or medium-load and high-rpm conditions, the failed actuation of the electromagnetic actuator 22 could potentially be very dangerous.

In some embodiments, upon re-enabling the strategy for the reduction of the noise caused by the movement of the mobile equipment (namely, of the control rod 21 and of the anchor 25) that hits the magnetic armature 26, the duration of the peak phase ΔT, during which the electromagnet 24 is to be excited with the control current I so as to give to the mobile equipment (namely, to the control rod 21 and to the anchor 25) the kinetic energy that is necessary and sufficient to move the rod 21 from the active position to the passive position, is equal to one of the following. First, the last value of the duration of the peak phase ΔT, during which the electromagnet 24 is to be excited with the control current I, prior to the disabling of the strategy for the reduction of the noise caused by the movement of the mobile equipment that hits the magnetic armature 26. Second, the last value of the initial peak phase $\Delta T_{START}$, during which the electromagnet 24 is to be excited with the control current I. Third, a weighted mean between the last value of the duration of the peak phase ΔT, during which the electromagnet (24) is to be excited with the control current I, prior to the disabling of the strategy for the reduction of the noise caused by the movement of the mobile equipment that hits the magnetic armature 26 and the value of the initial peak phase $\Delta T_{START}$, during which the electromagnet 24 is to be excited with the control current I. Or, fourth, the value of the initial peak phase $\Delta T_{START}$, during which the electromagnet 24 is to be excited with the control current I, corrected as in one of the following formulas [6] or [7]

$$\Delta T_{(j)}=\Delta T_{START(j)}+\Delta T_{(j-1)}-\Delta T_{START(j-1)} \quad [6]$$

$$\Delta T_{(j)}=\Delta T_{START(j)}*(\Delta T_{(j-1)}/\Delta T_{START(j-1)}) \quad [7]$$

where $\Delta T_{(j-1)}$ is the last value of the duration of the peak phase ΔT, during which the electromagnet 24 is to be excited with the control current I, prior to the disabling of the strategy for the reduction of the noise caused by the movement of the mobile equipment that hits the magnetic armature 26; $\Delta T_{START(j-1)}$ is the value of the initial peak phase $\Delta T_{START}$ upon last disabling the noise reduction strategy for the conditions available in that instant, such as, for example: battery voltage V, temperature of the winding of the electromagnetic actuator 22; temperature of the fuel used, speed of the internal combustion engine ICE; $\Delta T_{START(j)}$) is the value of the initial peak phase $\Delta T_{START}$ upon re-enabling the noise reduction strategy for the conditions available in that instant, such as, for example: battery voltage V, temperature of the winding of the electromagnetic actuator 22, temperature of the fuel used, or speed of the internal combustion engine ICE.

In one embodiment, a control system is provided, which, besides the control unit 7, also includes at least one sound pressure level sensor, namely a microphone, which is connected to the control unit 7 and is designed to detect the intensity S of the sound signal on the inside of the engine compartment. The internal combustion engine ICE, though, is not provided with the pressure sensor 11 used to detect, in real tome, the fuel pressure value on the inside of the common rail 3.

In one embodiment, the microphone is arranged in a position in which it directly faces and is close to the high-pressure pump 4. The microphone is arranged so as to detect the intensity S of the sound signal emitted by the high-pressure pump 4. The microphone is arranged in a position that allows it to also detect, besides the intensity S of the sound signal emitted by the high-pressure pump 4, the intensity of the sound signal emitted by other actuators of the internal combustion engine ICE, by the horn, by the presence of detonation phenomena, etc. The microphone is advantageously an omnidirectional microphone and, in order to capture the intensity S of the sound signal, it uses a sampling with a relatively wide frequency ranging from 20 Hz to 20 kHz (namely, the range of frequencies that can be perceived by human ears).

The non-filtered signal S, which is captured by the microphone, is rich in formation, but can hardly be linked to the noise produced by the high-pressure pump 4. Therefore, in order to obtain this information, the non-filtered signal should be analysed and, in particular, a fast Fourier transform—FFT should be carried out so as to divide the signal obtained into a sum of harmonics with different frequencies, amplitudes and phases.

Among the frequencies of the entire intensity spectrum of the filtered sound signal there are also those concerning the actuations of the electromagnetic actuator 22, namely relating to the impacts of the mobile equipment (namely, of the control rod 21 and the anchor 25) of the adjusting device 6 against the magnetic armature 26. Hence, the control unit 7 receives, as an input, the filtered sound signal and processes the filtered sound signal at the frequencies and with the angular windows relating to the actuations of the electromagnetic actuator 22, so as to analyse the impacts of the mobile equipment of the adjusting device 6 against the magnetic armature 26 of the high-pressure pump 4.

The filtered and processed sound signal S is used to control the electromagnetic actuator 22 of the high-pressure pump 4; in particular, the control unit 7 is configured to feedback-control the electromagnetic actuator 22 of the high-pressure pump 4 as a function of the filtered and processed sound signal S.

Again, in order to enable the strategy for the reduction of the noise of the high-pressure pump 4, the internal combustion engine ICE needs to be in specific conditions in terms of load and number of revolutions per minute. The control unit 7 is designed to enable the noise reduction strategy only in given load and rpm conditions. In particular, in a preliminary adjustment and set up phase to be performed on the control unit 7, one should determine load and rpm threshold values, below which the control unit 7 pursues the strategy for the reduction of the noise caused by the movement of the mobile equipment (namely, of the control rod 21 and the anchor 25) that hits the magnetic armature 26. The strategy for the reduction of the noise caused by the movement of the mobile equipment (namely, of the control rod 21 and the anchor 25) that hits the magnetic armature 26 is pursued only in a low-load and slow-running condition, namely with a low number of revolutions per minute.

Therefore, the control unit 7 is designed to excite the electromagnet 24 with the control current I, which is supplied during a peak phase ΔT and is such as to give to the mobile equipment (namely, to the control rod 21 and the anchor 25) the kinetic energy needed at the moment of the impact against the magnetic armature 26. The duration of the peak phase ΔT, during which the electromagnet 24 is to be excited with the control current I, is initialized to a value that is equal to the duration of the initial peak phase $\Delta T_{START}$ stored in the control unit 7.

Hence, the duration of the peak phase ΔT, during which the electromagnet 24 is to be supplied with the control current I, is progressively decreased until a value is reached, which is as close as possible to the "limit" duration that gives to the mobile equipment the minimum kinetic energy at the moment of the impact.

The duration of the peak phase ΔT, during which the electromagnet 24 is to be excited with the control current I, is progressively decreased by a quantity $\Delta T_{P1}$. In one embodiment, the duration of the peak phase ΔT, during which the electromagnet 24 is to be excited with the control current I, is decreased by a quantity $\Delta T_{P1}$ with every actuation of the electromagnetic actuator 22.

In an alternative embodiment, the duration of the peak phase ΔT, during which the electromagnet 24 is to be excited with the control current I, is kept constant over a given number $N_{A1}$ of actuations of the electromagnetic actuator 22 before decreasing it again by the quantity $\Delta T_{P1}$ In other words, the duration of the peak phase ΔT, during which the electromagnet 24 is to be excited with the control current I, is decreased by a quantity $\Delta T_{P1}$ with every given number $N_{A1}$ of actuations of the electromagnetic actuator 22.

As soon as the control unit 7 detects a decrease in the intensity of the filtered and processed sound signal S, it cuts off the step aimed at progressively decreasing the duration of the peak phase ΔT, during which the electromagnet 24 is to be excited with the control current I, by the quantity $\Delta T_{P1}$. As a matter of fact, a decrease in the intensity of the filtered and processed sound signal S means that there could have been a decrease in the flow-rate of the fuel flowing out of the high-pressure pump 4 caused by the loss of the actuation of the electromagnetic actuator 22.

In particular, the step aimed at progressively decreasing the duration of the peak phase ΔT, during which the electromagnet 24 is to be excited with the control current I, by the quantity $\Delta T_{P1}$ is cut off as soon as the control unit 7 detects a decrease in the intensity of the filtered and processed sound signal S, which is higher than a tolerance value, which is usually determined in a preliminary set up phase aimed at setting up the control unit 7. In other words, the step aimed at progressively decreasing the duration of the peak phase ΔT is cut off as soon as the control unit 7 detects an intensity of the filtered and processed sound signal S that is below a tolerance limit value for the filtered and processed sound signal S that is determined in a preliminary set up phase aimed at setting up the control unit 7.

As soon as the control unit 7 detects a decrease in the intensity of the filtered and processed sound signal S and, therefore, ascertains the possibility of a loss of actuation of the electromagnetic actuator 22, the duration of the peak phase ΔT, during which the electromagnet 24 is to be excited with the control current I, is increased by a safety value $\Delta T_P$, which is such as to ensure that the intensity of the filtered and processed sound signal S is caused to exceed the tolerance limit value for the filtered and processed sound signal S.

The increase by the safety value $\Delta T_P$ is necessary to go back to safety conditions, namely to avoid further losses of actuations of the electromagnetic actuator 22.

Therefore, in one embodiment, the control unit 7 is designed to excite the electromagnet 24 with the control current I, which is supplied during the peak phase ΔT and is such as to give to the mobile equipment (namely, to the control rod 21 and the anchor 25) the kinetic energy needed at the moment of the impact against the magnetic armature 26 over a number $N_A$ of actuations of the electromagnetic actuator 22.

Over the entire amount of time during which the duration of the peak phase ΔT is kept constant (namely, as the number $N_A$ of actuations of the electromagnetic actuator 22 are repeated) the intensity of the filtered and processed sound signal S is constantly monitored. If, over the entire amount of time during which the duration of the peak phase ΔT is kept constant (namely, as the number NA of actuations of the electromagnetic actuator 22 are repeated), the control unit 7 detects an excessively low level of the intensity of the filtered and processed sound signal S, the duration of the peak phase ΔT, during which the electromagnet 24 is to be excited with the control current I, is increased by the safety value $\Delta T_P$, so as to ensure that the intensity of the filtered and processed sound signal S is caused to exceed the tolerance limit value for the filtered and processed sound signal S.

In one embodiment, the control unit 7 is designed to excite the electromagnet 24 during the peak phase ΔT, whose duration is progressively decreased by a quantity $\Delta T_{P2}$, with the control current I, which is such as to give to the mobile equipment (namely, to the control rod 21 and the anchor 25) the kinetic energy needed at the moment of the impact against the magnetic armature 26.

In one embodiment, the duration of the peak phase ΔT, during which the electromagnet 24 is to be excited with the control current I, is decreased by a quantity $\Delta T_{P2}$ with every actuation of the electromagnetic actuator 22.

In an alternative embodiment, the duration of the peak phase ΔT, during which the electromagnet 24 is to be excited with the control current I, is kept constant over a given number $N_{A2}$ of actuations of the electromagnetic actuator 22 before decreasing it again by the quantity $\Delta T_{P2}$. In other words, the duration of the peak phase ΔT, during which the electromagnet 24 is to be excited with the control current I, is decreased by a quantity $\Delta T_{P2}$ with every given number $N_{A2}$ of actuations of the electromagnetic actuator 22.

During this entire further learning step, aimed at learning the duration of the peak phase ΔT, during which the electromagnet 24 is to be excited with the control current I so as to give to the mobile equipment (namely, to the control rod 21 and to the anchor 25) the kinetic energy needed at the moment of the impact against the magnetic armature 26, the intensity of the filtered and processed sound signal S is constantly monitored.

As soon as the control unit 7 detects a decrease in the intensity of the filtered and processed sound signal S, it cuts off the step aimed at progressively decreasing the duration of the peak phase ΔT, during which the electromagnet 24 is to be excited with the control current I, by the quantity $\Delta T_{P2}$.

In particular, the step aimed at progressively decreasing the duration of the peak phase ΔT, during which the electromagnet 24 is to be excited with the control current I, by the quantity $\Delta T_{P2}$ is cut off as soon as the control unit 7 detects a decrease in the intensity of the filtered and processed sound signal S, which is higher than a tolerance value, which is usually determined in a preliminary set up phase aimed at setting up the control unit 7. In other words, the step aimed at progressively decreasing the duration of the peak phase ΔT, during which the electromagnet 24 is to be excited with the control current I, by the quantity $\Delta T_{P2}$ is cut off as soon as the control unit 7 detects that the intensity of the filtered and processed sound signal S is below the tolerance value for the filtered and processed sound signal S, which is determined in a preliminary set up phase aimed at setting up the control unit 7.

As soon as the control unit 7 detects a decrease in the intensity of the filtered and processed sound signal S, the duration of the peak phase ΔT, during which the electromagnet 24 is to be excited with the control current I, is increased by a safety value $\Delta T_P$, which is such as to ensure that the intensity of the filtered and processed sound signal S is caused to exceed the tolerance limit value for the filtered and processed sound signal S.

The increase by the safety value $\Delta T_P$ is necessary to go back to safety conditions, namely to avoid further losses of actuations of the electromagnetic actuator 22.

The quantity $\Delta T_{P2}$ and the number $N_{A2}$ of actuations of the electromagnetic actuator 22 are determined so as to remain as close as possible to the "limit" conditions, namely so as to give to the mobile equipment the minimum kinetic energy at the moment of the impact and so as to avoid values that are below the "limit" duration, which would cause the loss of the actuation of the electromagnetic actuator 22.

Finally, the control unit 7 is designed to disable the strategy for the reduction of the noise caused by the movement of the mobile equipment (namely, of the control rod 21 and the anchor 25) that hits the magnetic armature 26 as soon as the internal combustion engine ICE is in high- or medium-load and high-rpm conditions (in other words, when the load and rpm threshold values established in a preliminary phase and stored in the control unit 7 are exceeded).

In one embodiment, in the control unit 7 there are stored a series of maps that respectively provide the duration of the initial peak phase $\Delta T_{START}$, the quantity $\Delta T_{P1}$, the number $N_{A1}$ of actuations, the safety value $\Delta T_P$, the number $N_A$ of actuations, the number $N_{A2}$ of actuations, the quantity $\Delta T_{P2}$ of the electromagnetic actuator as a function of a plurality of parameters, such as, for example: battery voltage V, temperature of the winding of the electromagnetic actuator 22, temperature of the fuel used, speed of the internal combustion engine ICE, etc.

In a further embodiment, a control system is provided, which, besides the control unit 7, also includes both the sound pressure level sensor, namely a microphone, which is connected to the control unit 7 and is designed to detect the intensity of the sound signal S on the inside of the engine compartment, and the pressure sensor 11, which detects, in real lime, the fuel pressure value on the inside of the common rail 3. In this case, one of the two parameters, i.e. the intensity of the sound signal S on the inside of the engine compartment detected by the microphone and the fuel pressure value on the inside of the common rail 3 detected by the pressure sensor 11, is used to validate the signal corning from the other sensor (namely, from the pressure sensor 11 and from the microphone, respectively) and, if necessary, to diagnose faults of the other sensor (namely, of the pressure sensor 11 and of the microphone, respectively).

In one embodiment, a control system is provided, which only includes the control unit 7 and is not provided with either the sound pressure level sensor, namely the microphone, to detect the intensity of the sound signal S on the inside of the engine compartment, or the pressure sensor 11, which is designed to detect, in real time, the fuel pressure value on the inside of the common rail 3. In this case, however, it is possible to enable the strategy to open-loop control the noise produced by the high-pressure pump 4 and, in particular, by the movement of the mobile equipment (namely, of the control rod 21 and the anchor 25) that hits the magnetic armature 26. The control unit 7 is designed to excite the electromagnet 24 with the peak control current I, which is supplied during a peak phase ΔT, which is such as to give to the mobile equipment (namely, to the control rod 21 and the anchor 25) the kinetic energy needed at the moment of the impact against the magnetic armature 26 and is variable as a function of a plurality of parameters, such as, for example: battery voltage V, temperature of the winding of the electromagnetic actuator 22, temperature of the fuel used, speed of the internal combustion engine ICE, etc.

It should be pointed out that, in the description above, the control unit 7 is designed to progressively decrease the duration of the peak phase ΔT of the actuation of the electromagnetic actuator 22, whereas the overall duration of the actuation of the electromagnetic actuator 22 (namely, of the Peak&Hold command subdivided into the peak phase ΔT and the hold phase) is kept constant. In other words, the duration of the hold phase of the actuation of the electromagnetic actuator 22 is progressively increased, so as to balance the progressive decrease in the duration of the peak phase ΔT of the actuation of the electromagnetic actuator 22 and so that the entire duration of the actuation of the electromagnetic actuator 22 is kept constant. Furthermore, in the description above, the control unit 7 is designed to excite the electromagnet 24 with a control current I with a constant amplitude and timing; in other words, the strategy described above does not act upon the intensity and the waveform of the control current I of the electromagnet 24 in order to minimize the kinetic energy of the mobile equipment (namely, of the control rod 21 and the anchor 25) at the moment of the impact against the magnetic armature 26.

In one embodiment, the control unit 7 is designed to increase the amplitude of the peak control current I supplied to the electromagnet 24 during the peak phase ΔT (keeping the timing constant); in other words, the strategy acts upon the intensity of the peak control current I of the electromagnet 24 in order to minimize ripples and, consequently, the chances of operating losses.

The method described above can advantageously be applied not only to control the electromagnetic actuator 22 of the high-pressure pump 4, but also to control any other actuation system of the internal combustion engine ICE that produces a periodical noise perceived as being annoying for human ears.

In other words, the method described above can advantageously be applied to all those electromagnetic actuators that control the impact of a component (in the present case, the control rod 21) that moves towards a position defined by a limit stop (in the present case, the magnetic armature 26). By way of example, the method described above can advantageously be used to control the actuation system of an injection group.

As set forth in the method as described, the impact of the mobile equipment, including the control rod 21 and the anchor 25, against the magnetic armature 26 is completed during the slowing-down (or decrease) phase of the current and not during the actual peak phase ΔT, during which the electromagnet 24 is excited with the peak control current I. Therefore, during the current slowing-down phase, the speed of the mobile equipment, including the control rod 21 and the anchor 25, is reduced and, consequently, there is a reduction of the noise produced by the impact of the mobile equipment, including the control rod 21 and the anchor 25, against the magnetic armature 26.

In one embodiment, with reference to the step during which the electromagnetic actuator 22 closes when there is the impact of the mobile equipment (namely, of the control rod 21 and the anchor 25) of the adjusting device 6 against the intake valve 18 at the end of the actuation electric command (namely, when the mobile equipment moves towards the active position) so as to reduce the kinetic energy of the mobile equipment at the moment of the impact against the intake valve 18, the control unit 7 is designed to excite the electromagnet 24 with a current peak I*, which is supplied over a time interval having a range and a timing that are such as to give to the mobile equipment (namely, to the control rod 21 and the anchor 25) the deceleration needed at the moment of the impact against the intake valve 18. In the control unit 7 there are stored a series of maps that respectively provide the duration, the amplitude and the timing of the current peak I* as a function of a plurality of parameters, such as, for example: battery voltage V, temperature of the winding of the electromagnetic actuator 22, temperature of the fuel used, speed of the internal combustion engine ICE, etc.

The method described above, which is used to control the high-pressure pump 4 and to reduce the noise caused by the movement of the mobile equipment (namely, of the control rod 21 and the anchor 25) that hits the magnetic armature 26, has many advantages.

First of all, in the high-pressure pump 4 described above there is a significant reduction of the periodical production of noise due to the impact of the mobile equipment (namely, of the control rod 21 and the anchor 25) of the adjusting device 6 against the magnetic armature 26. Furthermore, the method remarkably reduces the wear of the electromagnetic actuator 22 and, hence, increases its life.

Moreover, the method can advantageously be applied to also control other actuation systems of the internal combustion engine ICE that produce a periodical noise perceived as being annoying for human ears.

Finally, further advantages lie in the fact that the driving features of the vehicle are not affected by this strategy to reduce the noise caused by the movement of the mobile equipment (namely, of the control rod 21 and the anchor 25) that hits the magnetic armature 26 as well as in the reduced computing load of the control unit 7, which does not have to be excessively burdensome to implement the above strategy.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A method for controlling an electromagnetic actuator for a fuel pump, wherein the electromagnetic actuator is controlled by an electric current pulse of a Peak&Hold type subdivided into a peak phase and a hold phase; for each actuation of the electromagnetic actuator the method comprises:

acquiring an initial duration of the peak phase, during which a peak control current is to be supplied to the electromagnetic actuator to control a movement of a component of the electromagnetic actuator moving towards a position defined by a limit stop and acquiring a duration of the hold phase during which a hold control current is to be supplied to the electromagnetic actuator to maintain the component of the electromagnetic actuator in the position defined by the limit stop;

determining an effective duration of the peak phase by progressively decreasing the initial duration of the peak phase by a first change of duration, and supplying the peak control current to the electromagnetic actuator for the peak phase to control the movement of the component of the electromagnetic actuator moving towards the position defined by the limit stop and supplying the hold control current to the electromagnetic actuator for the hold phase to maintain the component of the electromagnetic actuator in the position defined by the limit stop.

2. The method as set forth in claim 1 comprising the further steps of:

identifying one condition from among a low-load, a slow-running or low rpm condition of the internal combustion engine; and allowing the effective duration of the peak phase, during which the peak control current is to be supplied to the electromagnetic actuator to control the movement of the component moving towards the position defined by the limit stop, to be determined by progressively decreasing the initial duration of the peak phase by a first change of duration, only in a case where the internal combustion engine is in the one condition from among the low-load, the slow-running or the low rpm condition.

3. The method as set forth in claim 1 comprising the further steps of:

identifying one condition from among a high-load, a medium-load or a high-rpm condition of the internal combustion engine; and preventing the effective duration of the peak phase, during which the peak control current is to be supplied to the electromagnetic actuator to control the movement of the component moving towards the position defined by the limit stop, from being determined by progressively decreasing the initial duration of the peak phase by a first change of duration, in a case where the internal combustion engine is in the one condition from among the high-load, the medium-load or the high-rpm condition.

4. The method as set forth in claim 1 comprising the further steps of:

determining a limit acceptability value for a fuel pressure value inside a common rail;

detecting the fuel pressure value inside the common rail; and allowing the effective duration of the peak phase, during which the peak control current is to be supplied to the electromagnetic actuator to control the movement of the component moving towards the position defined by the limit stop, to be determined by progressively decreasing the initial duration of the peak phase by a first change of duration, only in a case where the fuel pressure value inside the common rail is higher than the limit acceptability value for the fuel pressure value inside a common rail.

5. The method as set forth in claim 1 comprising the further steps of:

determining a tolerance value;

detecting a fuel pressure value inside a common rail; and preventing the effective duration of the peak phase, during which the peak control current is to be supplied to the electromagnetic actuator to control the movement of the component moving towards the position defined by the limit stop, from being determined by progressively decreasing the initial duration of the peak phase by a first change of duration, only in a case where the total reduction of the fuel pressure value inside the common rail for a number of successive working cycles is higher than the tolerance value.

6. The method as set forth in claim 4 comprising the further steps of:

detecting a fuel pressure value inside the common rail that is lower than the limit acceptability value for the fuel pressure value inside the common rail;

increasing the effective duration of the peak phase, during which the peak control current is to be supplied to the electromagnetic actuator to control the movement of the component moving towards the position defined by the limit stop, by a safety quantity; and supplying the peak control current to the electromagnetic actuator for the peak phase.

7. The method as set forth in claim 1 comprising the further steps of:

determining an interval of acceptable values for an intensity of a sound signal generated by the movement of the component moving towards the position defined by the limit stop;

capturing the intensity of the sound signal generated by the movement of the component moving towards the position defined by the limit stop; and allowing the effective duration of the peak phase, during which the peak control current is to be supplied to the electromagnetic actuator to control the movement of the component moving towards the position defined by the limit stop, to be determined by progressively decreasing the initial duration of the peak phase by a first change of duration, only in a case where the intensity of the sound signal generated by the movement of the component moving towards the position defined by the limit stop exceeds an acceptable limit value for the intensity of a sound signal generated by the movement of the component moving towards the position defined by the limit stop.

8. The method as set forth in claim 7 comprising the further steps of:

detecting the intensity of the sound signal generated by the movement of the component moving towards the position defined by the limit stop that is lower than the acceptable limit value for the intensity of the sound signal generated by the movement of the component moving towards the position defined by the limit stop;

increasing the effective duration of the peak phase, during which the control current is to be supplied to the electromagnetic actuator to control the movement of the component moving towards the position defined by the limit stop, by a safety quantity; and supplying the peak control current to the electromagnetic actuator for the peak phase.

9. The method as set forth in claim 4 comprising the further steps of:

providing a microphone to capture an intensity of a sound signal generated by the movement of the component moving towards the position defined by the limit stop;

providing a pressure sensor inside the common rail to detect the fuel pressure value; and comparing the fuel pressure value inside the common rail detected by the pressure sensor and the intensity of the sound signal generated by the movement of the component moving towards the position defined by the limit stop detected by the microphone, so as to determine a lack of actuation of the electromagnetic actuator.

10. The method as set forth in claim 9 comprising the further step of diagnosing a fault of the microphone or of the pressure sensor as a function of the comparison between the fuel pressure value inside the common rail detected by the pressure sensor and the intensity of the sound signal generated by the movement of the component moving towards the position defined by the limit stop.

11. The method as set forth in claim 1 comprising the further step of determining the effective duration of the peak phase, during which the peak control current is to be supplied to the electromagnetic actuator to control the movement of the component moving towards the position defined by the limit stop, according to the equation:

$$\Delta T_i = \Delta T_{i-1} - \Delta T_{P1}$$

wherein, $\Delta T_i$ is the effective duration of the peak phase, during which the peak control current is to be supplied for an i-th actuation of the electromagnetic actuator;

$\Delta T_{i-1}$ is the effective duration of the peak phase, during which the peak control current is to be supplied for an (i−1)-th actuation of the electromagnetic actuator;

$\Delta T_{P1}$ is a first change of duration; and i is a number of actuations of the electromagnetic actuator.

12. The method as set forth in claim 1 comprising the further step of determining the effective duration of the peak phase, during which the peak control current is to be supplied to the electromagnetic actuator to control the movement of the component moving towards the position defined by the limit stop, according to the equation:

$$\Delta T_i = \Delta T_{(i-NA1)} - \Delta T_{P1}$$

wherein, $\Delta T_i$ is the effective duration of the peak phase, during which the peak control current is to be supplied for an i-th actuation of the electromagnetic actuator;

$\Delta T_{(i-NA1)}$ is the effective duration of the peak phase, during which the peak control current is to be supplied for an $(i-N_{A1})$-th actuation of the electromagnetic actuator;

$\Delta T_{P1}$ is a first change of duration;

$N_{A1}$ is a first predetermined number of actuations of the electromagnetic actuator; and i is a number of actuations of the electromagnetic actuator.

13. The method as set forth in claim 6 comprising the further steps of:

determining a number of safety actuations of the electromagnetic actuator;

repeating a number of safety actuations of the electromagnetic actuator, in which the peak control current is to be supplied to the electromagnetic actuator for the peak phase.

14. The method as set forth in claim 6 comprising the further step of determining the duration of the peak phase, during which the peak control current is to be supplied to the electromagnetic actuator to control the movement of the component moving towards the position defined by the limit stop, according to the following equation:

$$\Delta T_i = \Delta T_{i-1} - \Delta T_{P2}$$

wherein, $\Delta T_i$ is the effective duration of the peak phase, during which the peak control current is to be supplied for an i-th actuation of the electromagnetic actuator;

$\Delta T_{i-1}$ is the effective duration of the peak phase, during which the peak control current is to be supplied for an (i−1)-th actuation of the electromagnetic actuator;

$\Delta T_{P2}$ is a second change of duration; and i is a number of actuations of the electromagnetic actuator.

15. The method as set forth in claim 6 comprising the further step of determining the duration of the peak phase, during which the peak control current is to be supplied to the electromagnetic actuator to control the movement of the component moving towards the position defined by the limit stop, according to the following equation:

$$\Delta T_i = \Delta T_{(i-NA2)} - \Delta T_{P2}$$

wherein, $\Delta T_i$ is the effective duration of the peak phase, during which the peak control current is to be supplied for an i-th actuation of the electromagnetic actuator;

$\Delta T_{(i-NA2)}$ is the effective duration of the peak phase, during which the peak control current is to be supplied for an (i-$N_{A2}$)-th actuation of the electromagnetic actuator;

$\Delta T_{P2}$ is a second change of duration;

$N_{A2}$ is a second predetermined number of actuations of the electromagnetic actuator; and i is a number of actuations of the electromagnetic actuator.

16. The method as set forth in claim 15, wherein:

$$\Delta T_{P2}/N_{A2} < \Delta T_{P1}/N_{A1}$$

wherein, $\Delta T_{P1}$ is a first change of duration;

$N_{A1}$ is a first predetermined number of actuations of the electromagnetic actuator;

$\Delta T_{P2}$ is the second change of duration; and $N_{A2}$ is the second predetermined number of actuations of the electromagnetic actuator.

17. The method as set forth in claim 1, wherein the initial duration of the peak phase, during which the peak control current is to be supplied to the electromagnetic actuator to control the movement of the component moving towards the position defined by the limit stop, is chosen among the following possibilities:

a last value of the duration of the peak phase, during which the electromagnet is to be excited with the peak control current; or a reference initial duration of the peak phase, during which the electromagnet is to be excited with the peak control current and which is determined in a preliminary set up phase; or a weighted mean between the last value of the duration of the peak phase, during which the electromagnet is to be excited with the peak control current, and the reference initial duration of the peak phase, during which the electromagnet is to be excited with the peak control current and which is determined in a preliminary set up phase; or a corrected reference initial duration of the peak phase, during which the electromagnet is to be excited with the peak control current and which is determined in a preliminary set up phase, corrected according to one of the following formulas:

$$\Delta T_{(j)} = \Delta T_{START(j)} + \Delta T_{(j-1)} - \Delta T_{START(j-1)}$$

$$\Delta T_{(j)} = \Delta T_{START(j)} * (\Delta T_{(j-1)} / \Delta T_{START(j-1)})$$

wherein:

$\Delta T_{(j-i)}$ is a last value of the duration of the peak phase, during which the electromagnet is to be excited with the peak control current;

$\Delta T_{START(j-1)}$ is a last value of the reference initial duration of the peak phase, during which the electromagnet is to be excited with the peak control current and which is determined in a preliminary set up phase as a function of at least one condition selected from among:

a battery voltage, a temperature of the winding of the electromagnetic actuator; a temperature of the fuel used, and a speed of the internal combustion engine; and $\Delta T_{START(j)}$ is a value of the reference initial duration of the peak phase, during which the electromagnet is to be excited with the control current and which is determined in a preliminary set up phase as a function of at least one condition selected from among: the battery voltage, the temperature of the winding of the electromagnetic actuator; the temperature of the fuel used, and the speed of the internal combustion engine.

18. The method as set forth in claim 15, wherein the reference initial duration of the peak phase and/or the first change of duration and/or the first number of actuations of the electromagnetic actuator and/or the safety quantity and/or the number of safety actuations of the electromagnetic actuator and/or the second change of duration and/or the second number of actuations of the electromagnetic actuator are variable and are determined as a function of a plurality of parameters selected from among: the battery voltage, the temperature of the winding of the electromagnetic actuator; the temperature of the fuel used, and the speed of the internal combustion engine.

19. The method as set forth in claim 1 comprising the further step of increasing an amplitude of the peak control current supplied to the electromagnet during the peak phase so as to reduce operating dispersions.

20. The method as set forth in claim 1, wherein the electromagnetic actuator is an electromagnetic actuator of a fuel pump of a direct-injection system comprising an intake channel, which is regulated by an intake valve, and a flow-rate adjusting device, which is mechanically coupled to the intake valve and comprises a control rod, which is coupled to the intake valve, and a ferromagnetic anchor, which is integral to the control rod; the method comprises supplying the peak control current to the electromagnetic actuator to control the movement of the assembly made up of the control rod and the ferromagnetic anchor, which moves towards the position defined by a fixed ferromagnetic anchor.

* * * * *